US009576563B2

(12) United States Patent
Güngör

(10) Patent No.: US 9,576,563 B2
(45) Date of Patent: Feb. 21, 2017

(54) TANK DRUM TUNING STRUCTURE

(71) Applicant: Deniz Güngör, Istanbul (TR)

(72) Inventor: Deniz Güngör, Istanbul (TR)

( * ) Notice: Subject to any disclaimer, the term of this patent is extended or adjusted under 35 U.S.C. 154(b) by 0 days.

(21) Appl. No.: 14/763,679

(22) PCT Filed: Jan. 29, 2014

(86) PCT No.: PCT/TR2014/000019

§ 371 (c)(1),
(2) Date: Jul. 27, 2015

(87) PCT Pub. No.: WO2014/120103

PCT Pub. Date: Aug. 7, 2014

(65) Prior Publication Data

US 2015/0364121 A1 Dec. 17, 2015

(30) Foreign Application Priority Data

Jan. 29, 2013 (TR) ..... u 2013 01086

(51) Int. Cl.
*G10D 13/02* (2006.01)
*G10D 13/08* (2006.01)

(52) U.S. Cl.
CPC ..... *G10D 13/023* (2013.01); *G10D 13/08* (2013.01)

(58) Field of Classification Search
CPC .... G10D 13/02; G10D 13/021; G10D 13/028; G10D 13/023; G10D 13/027; G10D 13/00
USPC ..... 84/411 R
See application file for complete search history.

(56) References Cited

U.S. PATENT DOCUMENTS 7,244,882 B1 * 7/2007 Colwell ..... G10D 13/00 84/312 R

FOREIGN PATENT DOCUMENTS

EP 2015287 A2 1/2009

OTHER PUBLICATIONS http://www.bing.com/images/search?q=milltone+drums+and+magnets&view=detailv2&&id=15F9F9D3A0713B5EA0B2505F8901109ADC8F8A46&selectedIndex=8&ccid=Vy9t4b7O&simid=608047750851985557&thid=OIP.M572f6de1bece7d1b0028602163745da9o0&ajaxhist=0 Miller, 2010.*

* cited by examiner

*Primary Examiner* — Kimberly Lockett
(74) *Attorney, Agent, or Firm* — Egbert Law Offices, PLLC

(57) ABSTRACT

A percussion instrument, specifically a tank drum having tongues that form playing parts and including a ground clearance in its body, and a tuning structure which by changing the center of gravity of the tank drum, enables its tuning. A magnet is placed under the tongues. A channel is provided on the tongues enabling the magnet to be moved back and forth with the help of a key.

3 Claims, 2 Drawing Sheets

TANK DRUM TUNING STRUCTURE

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The invention relates to tank drum that is used in professional or amateur music, in mentally challenged people's therapy, in child education (orff) areas.

The invention especially relates to a structure through which the tuning of a tank drum is easily accomplished.

2. Description of Related Art Including Information Disclosed Under 37 CFR 1.97 and 37 CFR 1.98.

Tank drum is a melodic percussion instrument device made of steel material. The said percussion instrument device can be played by hand or with a tool that can be used for percussion. The said percussion instrument which has a smooth sound and a round shape is an instrument used in yoga, meditation, treatment or in the treatment of children with autism (orff).

The tank drum used in invention can come in many shapes. It is easy to play and learn and it appeals to audial and visual senses. Thanks to the geometries it has, it makes it easy to harmonise with and to achieve melodies. The said tank drum's second is very wide. It has 26 note values that have more value than two octaves. The notes are located in a simple way. Related notes can be located next to each other.

In the current state of art, one cannot change the notes of the instrument. In the said percussion instrument, by placing magnets under the tongues that compose the playing parts, frequency, that is, note, can be changed although it takes a long effort to tamper with the tuning device inside the instrument by hand.

As a result; with the need for processes that used in tank drums tuning and with the insufficiency of the present solutions, it calls for a development in the related technical field.

BRIEF SUMMARY OF THE INVENTION

The present invention relates to an embodiment which meets the said needs, eliminates all the disadvantages and brings in additional advantages and makes it easy to tune the said tank drum.

The object of the invention is to enable the tuning of the tank drum which is a percussion instrument without tampering inside it with hand.

Another object of the invention is, by the means of the channel structures that opens to the middle of the tongues that form the playing parts, to change place of the magnets which enable to change the scale of the instrument completely and which are placed under the tongues.

Another object of the invention is to enable changing the tune by moving the magnet placed right under the channels that form the playing parts with the help of a key such as a thin pin, stick etc.

Another object of the instrument is to enable the tuning with magnets to be fast and accurate. Thus, it is possible to generate hundreds of different combinations. In addition to this, because of not using any mechanism, it protects the sound of instrument from any distortions.

To accomplish all the advantages mentioned above and to be explained below in detail, the present invention brings forward; the tank drum which is a percussion instrument, which has the tongues that form the playing parts and has a ground clearance in its body and by changing the center of gravity of the said tank drum, enable to tune it and a tune structure that has a magnet placed under the tongues, enable to move the said magnet back and forth with the help of a key, which includes a channel formed upon the tongues.

The structural and the characteristic features and all advantages of the present invention will be understood more clearly with the following figures and the detailed description written by referring to said figures. Therefore, the evaluation needs to be done by taking these figures and the detailed description into consideration.

BRIEF DESCRIPTION OF THE DRAWINGS

To fully understand the structure of the present invention and its advantages with additional elements, the evaluation needs to be done with the figures explained below.

The figures are not need to be scaled and the details which are not necessary to understand the present invention may have been neglected. Apart from that, the elements which are at least substantially identical and which at least have substantially identical functions are shown with the same numerals.

REFERENCE NUMBERS

1. Tank Drum
2. Tongue
3. Channel
4. Magnet
5; Key
6. Ground clearance

DETAILED DESCRIPTION OF THE INVENTION

In this detailed description the preferred alternatives of the tank drum's tune structure according to the invention, are explained with the intention of better explaining the subject and without causing any limiting effects.

Figure 1:
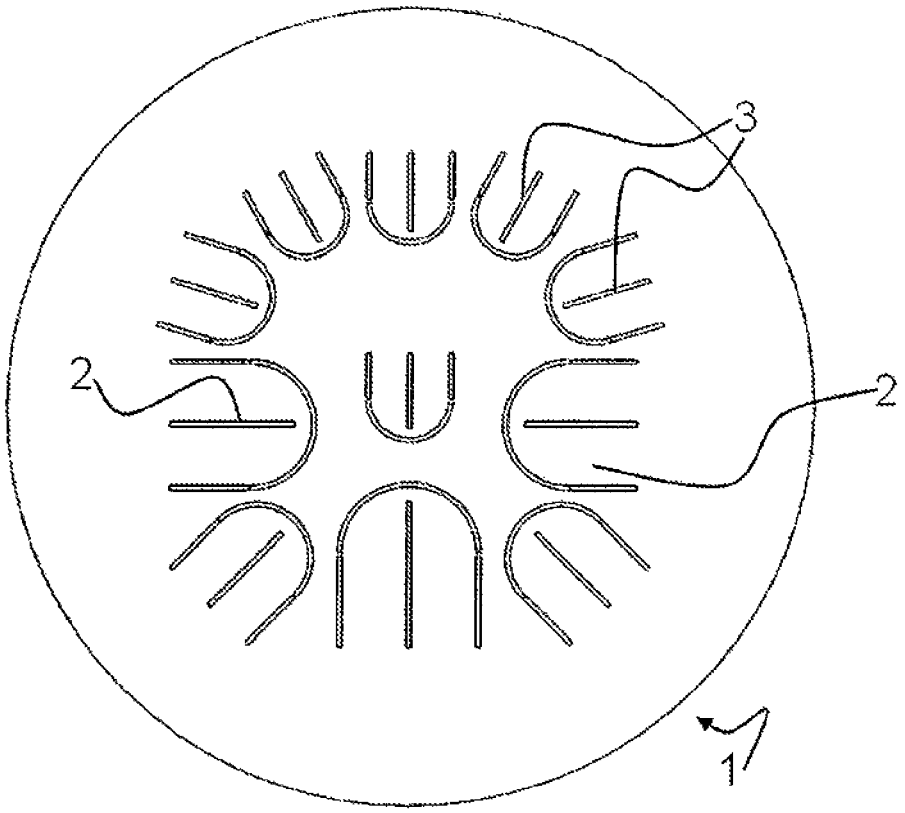
FIG. 1: The above view of the tank drum according to the invention.
Figure 2:
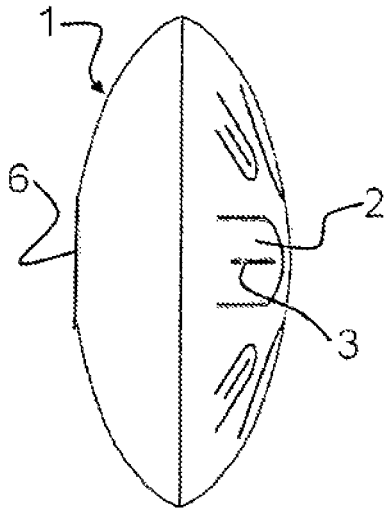
FIG. 2: The side view of the tank drum according to the invention.

The invention in its generic form is a tank drum (1) that contains tongues (2) forming the playing parts above them and above the said tongues (2) there are channels (3) and by hitting the different tongues (2) allowing to make music (FIG. 1 and FIG. 2). The said tongues (2) are structures with channels (3) formed above them and by hitting on those tongues (2) melodies are generated (FIG. 1).

The notes can be changed by tuning the tank drum (1) by the linearly movement of the magnet (4) on the channel (3) which is placed under the channels (3) opened under the tongues (2) mentioned in the invention. In the preferred embodiments of the invention, in order to move the magnet (4) through the channel (3) smoothly and easily, the said magnet (4) used is hallowed and/or has a socket. The said hallowed magnet (4) can be moved back and forth along the channel (3) with the help of a stick or a pin etc. which serves as a key (5).

The said tank drum (1), has a ground clearance (6) in the lower part of its body. The said magnet (4) is placed under the channels (3) with the help of the said ground clearance (6).

Figure 3:
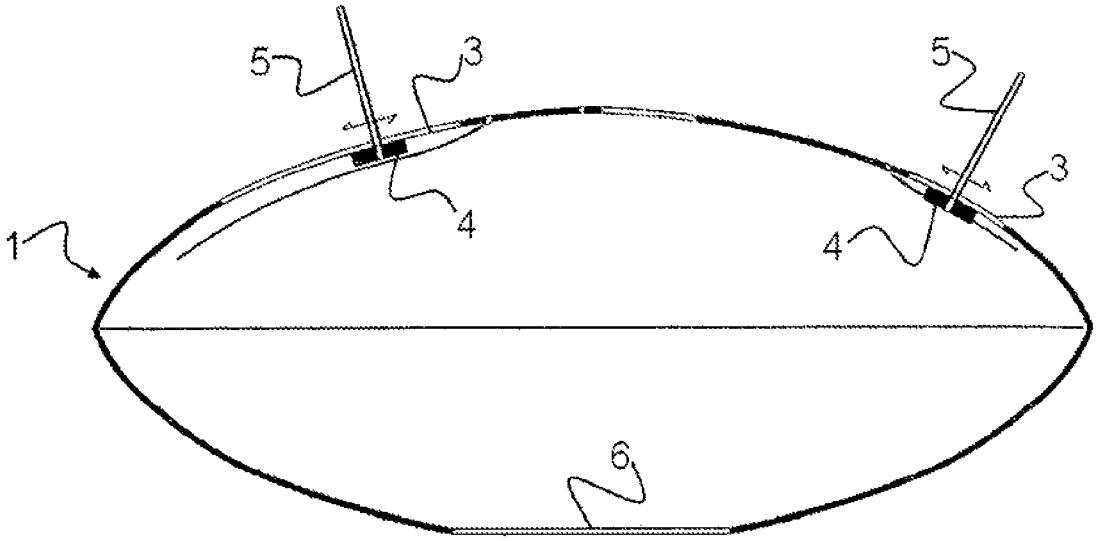
FIG. 3: The sectional view showing the tune structure of the tank drum according to the invention.

In the preferred embodiments of the invention, a channel (3) approximately 2 mm wide is opened in the middle of the said tongues (2) and a neodymium magnet (4) which is hallowed or had sockets is placed right under the said channel (3) (FIG. 3). The hole which is opened in the said magnet (4) is exactly aligned with the channels (3). This way, a key (5) like a thin stick, pin etc. can pass through both the channel (3) or the magnet's (4) hole and/or socket. Notes are marked on the tongues (2) on the said tank drum (1). The magnet (4) with the help of the thin stick key (5) by moving it back and forth under the tongue (2) is pushed through the place where notes are marked and thus the notes are changed. This way, tuning is made without hands inside the tank drum (1) and without a tuning device. In addition to this, playing comfort is not disturbed because there is nothing on the tongues (2) during playing.

As mentioned above, basically, even the said magnet (4) is not designed with a hole or a socket, with the help of the said key (5) it can be pushed back and forth from around the magnet (4). It makes the tuning process even easier if the said magnet has a hole and/or a socket.

The invention claimed is:

1. A tuning structure comprising:

a tank drum having a plurality of tongues and a ground clearance, said plurality of tongues being playing parts of said tank drum, said ground clearance being in a body of said tank drum;

a plurality of magnets respectively arranged at an underside of each of said plurality of tongues, said plurality of magnets operating to change a center of gravity respectively of said plurality of tongues so as to tune said tank drum; and a plurality of channels respectively formed in each of said plurality of tongues, said plurality of channels configured to respectively allow said plurality of magnets to move back and forth in a linear fashion along the corresponding channel.

2. The tuning structure of claim 1, each of said plurality of magnets having a hole or a socket.

3. The tuning structure of claim 1, further comprising:

a key that is a thin pin or a stick, each of said plurality of magnets being movable along the corresponding channel by an insertion of said key through the respective channel.

* * * * *